United States Patent [19]

Euteneuer et al.

[11] Patent Number: 4,534,519

[45] Date of Patent: Aug. 13, 1985

[54] PHOTOGRAPHIC PAPER ROLL CORE HOLDING DEVICE

[75] Inventors: Charles L. Euteneuer, St. Michael; Robert E. Diesch, Rogers, both of Minn.

[73] Assignee: Pako Corporation, Minneapolis, Minn.

[21] Appl. No.: 464,962

[22] Filed: Feb. 8, 1983

[51] Int. Cl.[3] ..... B65H 19/02; B65H 75/24

[52] U.S. Cl. ..... 242/68.3; 242/72 R

[58] Field of Search ..... 242/68.3, 72 R, 72 B, 242/72.1; 269/48.1, 48.2, 48.3, 48.4; 279/2 R, 2 A

[56] References Cited

U.S. PATENT DOCUMENTS

| | | | |
|---|---|---|---|
| 3,000,582 | 9/1961 | Brede | 242/68.3 X |
| 3,278,133 | 10/1966 | Froehlich | 242/68.3 |
| 3,356,310 | 12/1967 | Yokota | 242/68.3 |
| 3,606,188 | 9/1971 | Wagner | 242/68.3 |
| 3,724,772 | 4/1973 | Hager et al. | 242/68.3 |
| 3,825,203 | 7/1974 | Kjos et al. | 242/68.3 |
| 4,422,590 | 12/1983 | Rathbone | 242/68.3 |

*Primary Examiner*—Harvey C. Hornsby

*Assistant Examiner*—Scott J. Haugland

*Attorney, Agent, or Firm*—Kinney & Lange

[57] ABSTRACT

A holding device for securing a photographic paper roll core concentrically about a rotatable shaft has a resilient clamping ring positioned concentrically about the shaft. An annular shoulder is fixed on the shaft on one side of the resilient clamping ring and a cylindrical compression sleeve is positioned concentrically about the shaft on the other side of the resilient clamping ring with the cylindrical compression sleeve being movable in axial direction along the shaft. A spring bias apparatus normally urges the cylindrical compression sleeve away from the shoulder so that the resilient clamping ring is in a first radially retracted position. The holding device has a lever-actuated cam assembly for urging the cylindrical compression sleeve toward the shoulder upon actuation of the cam assembly. In so doing, the cam assembly overcomes the urging of the spring bias means so that the resilient clamping ring is deformed between the cylindrical compression sleeve and the shoulder into a second radially-extended position in which the resilient clamping ring engages an inner radial surface of the paper roll core to secure the paper roll core for rotation with the shaft.

10 Claims, 4 Drawing Figures

PHOTOGRAPHIC PAPER ROLL CORE HOLDING DEVICE

BACKGROUND OF THE INVENTION

1. Field of the Invention

The present invention relates to photographic processing equipment. In particular, the invention relates to a holding device for securing a photographic paper roll core concentrically about a rotatable shaft.

2. Description of the Prior Art

Photographic prints are typically made from photographic film negatives. Such prints are made on photographic paper which is manufactured and handled in bulk rolls. These rolls are usually carried on a central hub or core of suitable rigid material, such as cardboard or plastic. In making such prints, the core and roll of photographic film mounted thereon are positioned on photoprocessing equipment (such as a photographic print cutter) so that the photographic paper may be unrolled or unwound from the core for processing purposes. Thus, the core must be secured to a rotatable shaft to permit the uniform unwinding of the photographic paper thereon.

Prior art devices for securing such cores on shafts were cumbersome in use and slow to activate. They generally included a plurality of resilient rings and rigid spacers alternatively positioned concentrically about a rotatable shaft with a nut or clamping ring threadably mounted on the end of the shaft which could be tightened down against the rings and spacers to expand the rings radially outwardly from the shaft and for gripping the paper roll core. A plurality of resilient rings was required on these devices because of the need for gripping different sizes of paper roll cores (for different widths of photographic paper). The need for a plurality of resilient rings caused several problems with such devices. For instance, with constant use, the ring concentricities would become misaligned, thus making it difficult to quickly and easily slide the cores on and off of the holding device because it would become hung up on the misaligned rings. In addition, when clamping a core of narrow width, the outermost resilient rings would necessarily be forced to be fully compressed (to "bottom out") before the inner ring(s) gripping the core would be deformed, thus requiring more time to tighten the nut or clamping ring on the rotatable shaft. Additionally, the only way to tell whether the paper roll core was secured to the rotatable shaft was by "feel" of the operator, depending mainly on how tight that operator could secure the nut or clamping ring on the shaft.

The prior art holding devices have been inconsistent with high production photographic processing. Excessive operator time is required to position and secure the paper roll core on the rotatable shaft, and even then, the degree of securement of the core is dependent upon the operator's strength and sense of feel.

SUMMARY OF THE INVENTION

The present invention overcomes the problems of the prior art by providing a quick, uniform and efficient means for securing the photographic paper roll core concentrically about a rotatable shaft. The holding device of the present invention comprises a resilient clamping ring positioned concentrically about the shaft with an annular shoulder portion fixed concentrically about the shaft on one side of the resilient clamping ring. On the other side of the resilient clamping ring, a cylindrical compression sleeve is also positioned concentrically about the shaft and is movable in an axial direction along the shaft. Spring bias means normally urge the cylindrical compression sleeve away from the shoulder so that the resilient clamping ring is in a first radially-retracted position. Cam-actuated means selectively urge the cylindrical compression sleeve toward the shoulder, with the cam-actuated means overcoming the urging of the spring bias means so that the resilient clamping ring is deformed between the cylindrical compression sleeve and the shoulder into a second radially-extended position in which the resilient clamping ring engages an inner radial surface of the paper roll core to secure the paper roll core for rotation with the shaft.

The holding device of the present invention provides a simple and durable means for quickly securing a paper roll core about a rotatable shaft. The resilient ring is positioned proximate an inner end of the shaft so that paper roll cores of varying widths will always be contacted by it. Because of its unique construction, the holding device of the present invention requires only one resilient clamping ring, thus eliminating the problems of the prior art devices because of their need for a plurality of rings. The holding device of the present invention is quickly placed in a core clamping position by simply activating the cam-actuated means, which preferably is a lever arm pivotally mounted proximate an outer end of the shaft and which causes the cylindrical compression sleeve to be moved toward the shoulder. The operator is thus relieved of the need for guessing as to how firmly the core is secured to the shaft. The cam-actuated means and spring bias means of the holding device combine to apply a constant and uniform pressure to the resilient clamping ring and in turn to the inner radial surface of the paper roll core to secure the paper roll core for rotation with the shaft.

DETAILED DESCRIPTION OF THE PREFERRED EMBODIMENTS

Figures 1, 2, 3, 4:
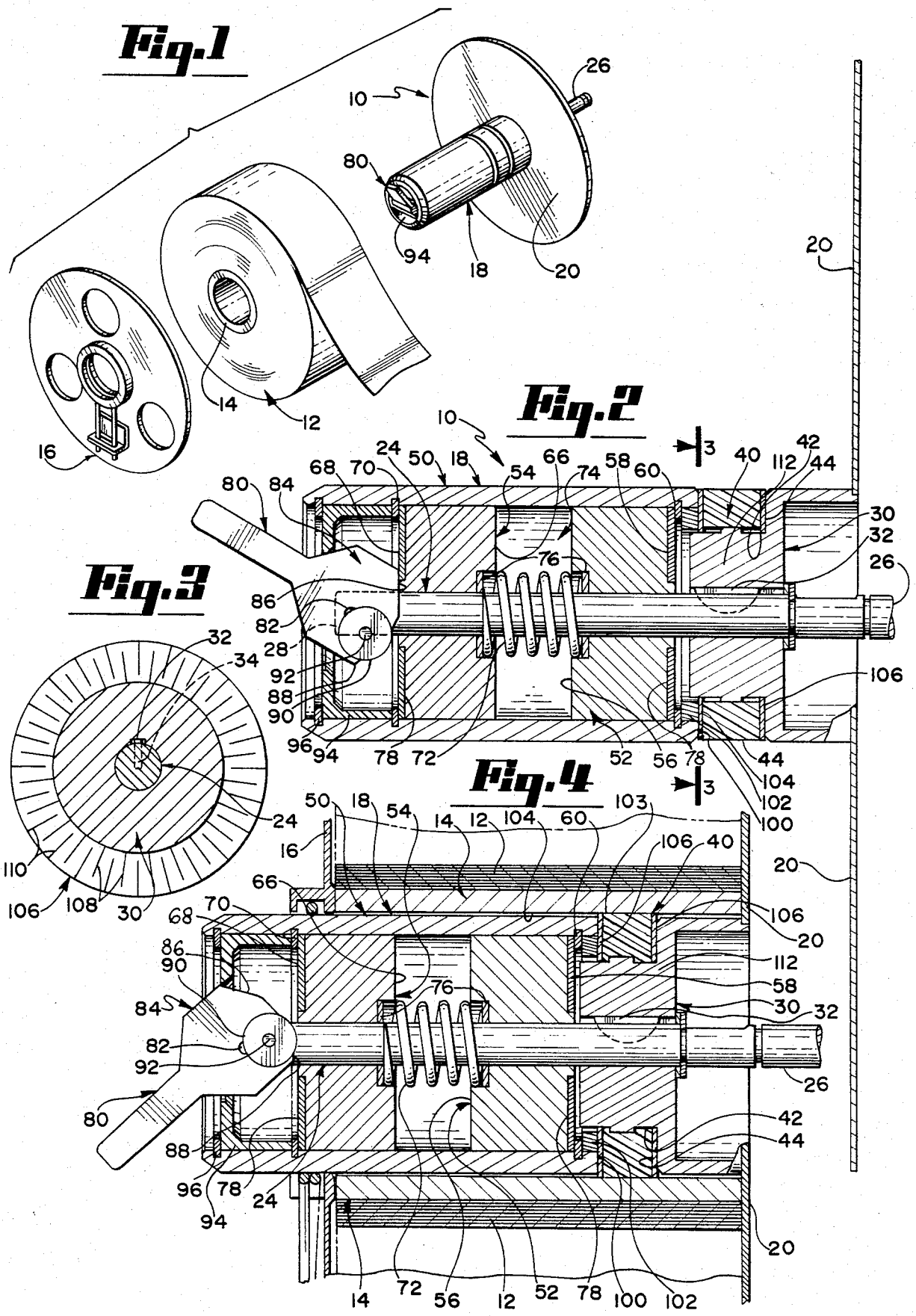
FIG. 1 is an exploded pictoral view of the holding device of the present invention, a roll of photographic print paper on a photographic paper roll core and an outer plate for maintaining the photographic print paper in alignment during winding or unwinding.
FIG. 2 is a side elevational view (in section) of the holding device of the present invention in a unclamped state.
FIG. 3 is a sectional view as taken along line 3—3 in FIG. 2.
FIG. 4 is a side elevational view (in section) of the holding device of the present invention (with the photographic print paper roll and paper roll core) showing the holding device in a clamped state.

FIG. 1 shows a core holding device 10 of the present invention which is used in conjunction with photoprocessing equipment such as a photographic print cutter (not shown) in which individual prints are cut from a web of photographic print paper. The web previously has been wound as a paper roll 12 on a photographic paper roll core 14 during processing, and the web/paper roll 12 is unwound from the core 14 during operation of the print cutter. The core 14 and paper roll 12 mounted thereon are mounted on the holding device 10 by sliding the core 14 onto a cylindrical portion 18 of the holding device 10 until the core 14 abuts an inner paper alignment plate 20 on the holding device 10. An outer paper alignment plate 16 is then also slid onto the cylindrical portion 18 to abut the core 14. Once in position, the outer plate 16 is secured to the cylindrical portion 18 to limit axial movement of the core 14 (i.e., along the direction of insertion). The core 14 and paper roll 12 are thus aligned between the outer plate 16 and the inner plate 20 to maintain the photographic print paper in alignment during winding or unwinding of the paper web from the core 14.

The core holding device 10 is shown generally in section in FIG. 2. The holding device 10 includes a rotatable shaft 24 having an inner end 26 and an outer end 28 defining a rotational axis for the shaft 24. The shaft 24 is connected adjacent its inner end 26 to certain photoprocessing equipment such as a print cutter (not shown) which includes bearing means for permitting the shaft 24 to rotate on its axis and may include drive means for causing the shaft 24 to be rotated and brake means for preventing the shaft 24 from being rotated. As shown, cylindrical portion 18 and inner plate 20 are mounted so as to be concentrically positioned about the axis of the shaft 24.

The cylindrical portion 18 includes an annular shoulder portion 30 adjacent the inner end 26 of the shaft 24. The shoulder portion 30 is positioned concentrically about the shaft 24 and is secured to the shaft 24 by a key 32 positioned in a keyway 34 (see FIGS. 2 and 3) in the shaft 24. The inner paper alignment plate 20 is secured to the shoulder portion 30 to also rotate when the shaft 24 rotates.

The shoulder portion 30 has an annular cut-out or notch for reception of a resilient clamping ring 40. The cut-out is defined by a lower circumferential surface 42 extending concentrically about the shaft 24 and a generally perpendicular (with respect to the axial direction of the shaft 24) radial face 44 also extending concentrically about the shaft 24, as best shown in FIG. 2.

A cylindrical compression sleeve 50 is also positioned concentrically about the shaft 24. The compression sleeve 50 is not fixed to the shaft, but rather is movable along the axial direction of the shaft 24. The cylindrical compression sleeve 50 is maintained in position concentrically about the axis of the shaft by a first member 52 and a second member 54, both of which are positioned concentrically about the shaft 24 and within the compression sleeve 50, which is generally tubular in shape. The first member 52 is slidably movable (with respect to both the shaft 24 and the compression sleeve 50) along the axial direction of the shaft 24 and has an inner spring side 56 and an opposite outer push side 58 adjacent the resilient clamping ring 40. Both the inner spring side 56 and outer push side 58 are generally perpendicular to the axial direction of the shaft 24, with the outer push side 58 engaging a first inner annular rim 60 of the compression sleeve 50. Thus, whenever the first member 52 is moved along the axis of the shaft 24 toward the resilient clamping ring, it engages the first inner annular rim 60 and forces the compression sleeve 50 to also move in direction toward the clamping ring 40.

The second member 54 is also slidably movable (with respect to both the shaft 24 and the compression sleeve 50) along the axial direction of the shaft 24. The second member 54 has an inner spring side 66 and an opposite outer press side 68 adjacent the second end 28 of the shaft 24. Both the inner spring side 66 and outer press side 68 are generally perpendicular to the axis of the shaft 24, with the outer press side 68 engaging a second inner annular rim 70 of the compression sleeve 50. Thus, whenever the second member 54 is moved along the axis of the shaft 24 toward its second end 28, it engages the second inner annular rim 70 of the compression sleeve 50 and forces the compression sleeve 50 to also move in the same direction.

Bias means, such as a coiled compression spring 72 positioned concentrically about the shaft 24, acts on the inner spring sides 56 and 66 of the first and second members 52 and 54 to urge them apart along the axial direction of the shaft 24. The first and second inner annular rims 60 and 70 of the compression sleeve 50 prevent movement of the first and second members 52 and 54 away from each other past the predetermined space shown in FIG. 2 as area 74. Each end of the coiled spring 72 engages one of the inner spring sides 56 and 66 of the first and second members 52 and 54. The ends of the coiled spring 72 are retained in each member by a spring notch or cut-out which has a spring plate 76 therein. Thrust plates 78 are positioned on the outer push side 58 and outer press side 68 of the first and second members 52 and 54, with the respective thrust plates 78 actually engaging the first and second inner annular rims 60 and 70, as shown. The area 74 between the first and second members 52 and 54 is smaller than that required by the coiled spring 72 in an umcompressed state so that the coiled spring 72 constantly urges the first and second members 52 and 54 away from each other and toward the inner annular rims 60 and 70 of the compression sleeve 50. Thus, any force tending to push the first and second members 52 and 54 together is resisted by the urging force of the coiled spring 72.

Movement of the cylindrical compression sleeve 50 along the axial direction of the shaft 24 is controlled by a lever arm 80. The lever arm 80 is pivotally mounted proximate the second end 28 of the shaft 24 (as at pivot point 82) on a lateral axis generally perpendicular to the axial direction of the shaft 24 and has a cam portion 84 as shown. The cam portion 84 has two active cam surfaces: a first cam surface 86 and a second cam surface 88. When the lever arm 82 is pivoted to position as shown in FIG. 2, it is in its first unclamped position and the first cam surface 86 of the cam portion 84 engages the outer press side 68 (and thrust plate 78) of the second member 54. The cam portion 84 is aligned on the shaft 24 so that when the lever arm 80 is in its first unclamped position, the first cam surface 86 is generally planar with the second inner annular rim 70. Thus, the outer press side 68 (and thrust plate 78) of the second member 54 engages both the second inner annular rim 70 and the first cam surface 86 of the cam portion 84 to limit movement of the second member 54 in direction toward the second end 28 of the shaft 24.

A freely rotatable bearing 90 is pivotally mounted on the cam portion 84 adjacent the second cam surface 88 (as at 92) and extends beyond the second cam surface 88 as shown. Thus, when the lever arm 80 is pivoted to position as shown in FIG. 4, it is in its second clamped position and the bearing 90 and second cam surface 88 engage the outer press side 68 (and thrust plate 78) of the second member 54. Thus, the lever arm 80 is placed in either its first unclamped position or second clamped position, which alternatively engages the outer press side 68 (and thrust plate 78) of the second member 54 with (1) the first cam surface 86 of the cam portion 84 or (2) the bearing 90 and second cam surface 88 of the cam portion 84, respectively. The bearing 90 on the cam portion 84 permits easy movement of the lever arm 80 between its first unclamped position and second clamped position.

As shown, the cylindrical compression sleeve 50 extends beyond the second inner annular rim 70 a distance to substantially enclose the cam portion 84 of the lever arm 80. An end cover 94 is secured within the compression sleeve 50 between the second inner annular rim 70 and a third inner annular rim 96. Of course, the end cover 94 has an opening through which the lever arm 80 extends, with the opening being of size sufficient to permit the lever arm 80 to pivot between its first unclamped position and second clamped position.

As stated, the cylindrical compression sleeve 50 is generally tubular in shape. Adjacent the resilient ring 40, the compression sleeve 50 has an annular ring side or surface 100 best illustrated by FIGS. 2 and 4. In addition to the ring surface 100, a spacer 102 is provided within the compression sleeve 50 between the first inner annular rim 60 and the resilient ring 40 to present a uniform compression surface adjacent the resilient ring 40. Resilient ring 40 is thus positioned on the core holding device 10 between the annular shoulder 30 and the compression sleeve 50. The spacer 102 is positioned such that when the compression sleeve 50 moves along the axial direction of the shaft 24, the spacer 102 moves with it.

As shown in FIG. 2, the resilient ring 40 is in its radially retracted position when the lever arm 80 is in its first unclamped position because engagement of the first cam surface 86 of the cam portion 84 with the outer press side 68 of the second member 54 does not cause the cylindrical compression sleeve 50 to move toward the annular shoulder 30. The coiled spring 72 maintains the second member 54 and compression sleeve 50 (through the force of the second member 54 on the second inner annular rim 70 of the compression sleeve 50) in position as shown in FIG. 2, with the outer press side 68 of the second member 54 abutting the first cam surface 86 of the cam portion 84. In its radially retracted position, the resilient ring 40 provides an outer cylindrical surface substantially similar (in diameter) to those such surfaces of the annular shoulder 30 and the compression sleeve 50. Thus, the paper roll core 14 can be slid onto the cylindrical portion 18 and over the resilient ring 40 to abut the inner paper alignment plate 20 on the holding device 10. Once the core 14 has been placed in this position (as in FIG. 3), the lever arm 80 is pivoted to its second clamped position wherein the the bearing 90 and the second cam surface 88 of the cam portion 84 engage the outer press side 68 of the second member 54.

The surface engagement points of the bearing 90 and second cam surface 88 on the outer press side 68 are further in radius from the pivot point 82 of the lever arm 80 than the first cam surface 86. Thus, the movement of the lever arm 80 from its first unclamped position to its second clamped position forces the second member 54 to move toward the first member 52. This movement further compresses the coiled spring 72, which in turn forces the outer push side 58 of the first member 52 against the first inner annular rim 60 of the compression sleeve 50 to cause the compression sleeve 50 to move toward the annular shoulder 30 until the second inner annular rim 70 is again in engagement with the outer press side 68 of the second member 54. The first and second members 52 and 54, coiled spring 72 and compression sleeve 50 thus all move axially toward the annular shoulder 30 upon movement of the lever arm 80 to its second clamped position. During such movement, the coiled spring 72 continually urges the first and second members 52 and 54 apart to substantially maintain the area 74 as a space therebetween. In addition, the first and second inner annular rims 60 and 70 limit movement of the members 52 and 54 away from each other and provide means for the members 52 and 54 to engage the compression sleeve 50 during their movement so that the compression sleeve 50 is also moved. The axial movement of the compression sleeve 50 toward the annular shoulder 30 deforms the resilient ring 40 into a radially extended position, as shown in FIG. 4. In this radially extended position, an outer cylindrical surface 103 of the resilient ring 40 engages an inner cylindrical surface 104 of the paper core core 14 to secure the core 14 for rotation with the shaft 24.

In order to most efficiently transmit the linear motion (and force) of the compression sleeve 50 along the axial direction of the shaft 24 into a radial motion (and force) of the resilient ring 40 outwardly from the shaft 24, a friction reducing polymer expansion ring 106 is positioned on each side of the resilient ring 40, as shown in FIGS. 2 and 4. As best shown in FIG. 3, each expansion ring 106 has a plurality of cuts 108 extending radially outward from its inner annular edge and a plurality of cuts 110 extending radially inwardly from its outer annular edge. These cuts 108 and 110 permit uniform radial outward expansion of each expansion ring 106 as the resilient ring 40 is deformed radially outwardly from the shaft 24. The friction reducing characteristics of the expansion rings 106 minimize the resistance caused by friction between the expansion rings 106 and the annular surface 100 and spacer 102 on one side of the resilient ring 40, and the surface 44 in the annular shoulder portion 30 on the other side of the resilient ring 40. Thus, the resilient ring 40 is able to move radially outwardly from the shaft 24 in a uniform concentric manner to completely engage the inner cylindrical surface 104 of the paper core core 14.

Of course, the annular shoulder 30 is fixed in position relative to the movement of the compression sleeve 50 toward the resilient ring 40 so that the resilient ring 40 can do nothing but deform as a result of such movement. Annular shoulder 30 has an annular ring support portion 112 extending concentrically about the shaft about which the resilient ring 40 is concentrically placed. The surface 42 of the annular shoulder 30 comprises the outer cylindrical surface of the ring support portion 112, and provides an interior surface for the resilient ring 40 to prevent deformation of the resilient ring 40 radially inwardly upon movement of the compression sleeve 50 toward the annular shoulder 30. Substantially all of the deformation of the radial ring 40 is therefore directed in a radial outward direction, where it is most efficiently put to use for clamping.

As shown in FIG. 4, actuation of the lever arm 80 causes the compression sleeve 50 to move toward the annular shoulder 30 and deform the resilient ring 40 radially outwardly to engage the inner radial surface 104 of the paper core core 14. The paper core core 14 is thus secured on the cylindrical portion 18 of the core holding device 10 to rotate as the shaft 24 is rotated. To completely secure the core 14 and photographic print paper roll 12 thereon onto the core holding device 10, the outer paper alignment plate 16 is secured onto the cylindrical portion 18 as shown. The photographic print paper roll 12 is thus ready for use in photoprocessing, being mounted on the photoprocessing equipment (not shown) in a secure fashion by the quick and simple clamping device of the present invention.

To remove the paper core core 14 from the core holding device 10, the lever arm 80 is simply pivoted to position as shown in FIG. 2 (the first unclamped position), thereby permitting the coiled spring 72 to expand and force the second member 54 and the compression sleeve 50 away from the annular shoulder 30. The movement of the compression sleeve 50 away from the annular shoulder 30 (caused both by the movement of the second member 54 toward the second end 28 of the shaft 24 and the natural tendancy of the resilient ring 40 in compression to return to its retracted position) permits the resilient ring 40 to return to its radially retracted position wherein its outer cylindrical surface 103 is substantially similar to the outer cylindrical surface of the rest of the cylindrical portion 18. The outer paper alignment plate 16 is removed from the cylindrical portion 18 and then the core 14 can also be removed. The present invention efficiently translates the pivotal motion of the lever arm 80 first into the linear motion of the compression sleeve 50 and then into the radial expansion (or retraction) of the resilient ring 40. The core holding device 10 provides a secure clamping means for holding a paper roll core for controlled rotation during photoprocessing with a minimum of moving parts, effort or guesswork by an operator.

Although the present invention has been described with reference to preferred embodiments, workers skilled in the art will recognize that changes may be made in form and detail without departing from the spirit and scope of the invention.

What is claimed is:

1. A holding device for securing a photographic paper roll core having an inner cylindrical surface concentrically about a rotatable shaft, the holding device comprising:

an annular shoulder portion fixed concentrically about the shaft;

a cylindrical compression sleeve positioned concentrically about the shaft and movable in an axial direction along the shaft;

a resilient clamping ring positioned concentrically about the shaft between the shoulder and the cylindrical compression sleeve;

cam actuated means for selectively urging the cylindrical compression sleeve toward the shoulder so that the resilient clamping ring is deformed from a first radially retracted position between the cylindrical compression sleeve and the shoulder into a second radially extended position in which the resilient clamping ring engages the inner cylindrical surface of the paper roll core to secure the paper roll core for rotation with the shaft;

spring bias means for transmitting the urging force from the cam actuated means to the cylindrical sleeve; and a friction reducing expansion ring between the resilient ring and the cylindrical compression sleeve and a friction reducing expansion ring between the resilient ring and the annular shoulder each of which expansion rings expands radially for uniformly permitting the resilient ring to move radially outwardly from the shaft and concentrically engage the inner cylindrical surface of the paper roll core.

2. A holding device for securing a photographic paper roll core having an inner cylindrical surface concentrically about a rotatable shaft which has a first end and a second end, the holding device comprising:

an annular shoulder portion fixed concentrically about the shaft adjacent the first end thereof;

a cylindrical compression sleeve positioned concentrically about the shaft and movable in an axial direction along the shaft;

a resilient clamping ring positioned concentrically about the shaft between the shoulder and the cylindrical compression sleeve;

cam actuated means for selectively urging the cylindrical compression sleeve toward the shoulder so that the resilient clamping ring is deformed from a first radially retracted position between the cylindrical compression sleeve and the shoulder into a second radially extended position in which the resilient clamping ring engages the inner cylindrical surface of the paper roll core to secure the paper roll core for rotation with the shaft;

spring bias means for transmitting the urging force from the cam actuated means to the cylindrical sleeve which includes a first inner annular rim on the compression sleeve, a first member positioned concentrically about the shaft and within the cylindrical compression sleeve, the first member being slidably movable along the axial direction of the shaft and having an inner spring side and an opposite outer push side adjacent the resilient ring, with the outer push side of the first member engaging the first inner annular rim of the cylindrical compression sleeve, a second inner annular rim on the compression sleeve, a second member positioned concentrically about the shaft and within the cylindrical compression sleeve, the second member being slidably movable along the axial direction of the shaft and having an inner spring side facing the inner spring side of the first member and an opposite outer press side adjacent the second end of the shaft, with the outer press side of the second member engaging the second inner annular rim of the cylindrical compression sleeve, and spring means acting on the inner spring sides of the first and second members for urging them apart along the axial direction of the shaft; and friction reducing means between the resilient ring and the cylindrical compression sleeve and between the resilient ring and the annular shoulder for uniformly permitting the resilient ring to move radially outwardly from the shaft and concentrically engage the inner cylindrical surface of the paper roll core.

3. The holding device of claim 2 wherein the spring means comprises a coiled compression spring positioned concentrically about the shaft with ends of the spring engaging the inner spring sides of the first and second members.

4. The holding device of claim 3 wherein the inner annular rims of the cylindrical compression sleeve prevent movement of the first and second members away from each other past a predetermined space which is smaller than that required by the coiled spring in an uncompressed state so that the coiled spring constantly urges the first and second members away from each other and toward the inner annular rims of the cylindrical compression sleeve.

5. The holding device of claim 2 wherein the cam actuated means comprises:

a lever arm pivotally mounted on a lateral axis proximate the second end of the rotatable shaft, the lever arm having a cam portion with first and second surfaces which alternatively engage the outer press side of the second member when the lever arm is pivoted between a first unclamped position and a second clamped position, respectively.

6. The holding device of claim 5 wherein the resilient ring is in its radially retracted position when the lever arm is in its first unclamped position because engagement of the first surface of the cam portion with the outer press side of the second member does not cause the cylindrical compression sleeve to move toward the annular shoulder, and the resilient ring is in its radially extended position when the lever arm is in its second clamped position because engagement of the second surface of the cam portion with the outer press side of the second member causes the second member to move toward the first member which, through the spring means, forces the outer push side of the first member against the first inner annular rim of the cylindrical compression sleeve to cause the cylindrical compression sleeve to move toward the annular shoulder and thereby deform the resilient ring.

7. The holding device of claim 1 wherein each friction reducing expansion ring comprises a polymer expansion ring on each axial side of the resilient ring.

8. The holding device of claim 1 wherein the annular shoulder has an annular ring support portion extending concentrically about the shaft and about which the resilient clamping ring is concentrically placed to provide an interior surface to prevent deformation of the resilient clamping ring radially inwardly.

9. A holding device for selectively securing a photographic paper roll core having an inner cylindrical surface concentrically about a rotatable shaft, the holding device comprising:

an annular stop shoulder fixed to the shaft adjacent a first end thereof and the stop shoulder having a side surface;

a resilient ring positioned concentrically about the shaft adjacent the side surface of the stop shoulder;

a first cylindrical member positioned concentrically about the shaft and being slidably movable with respect to the shaft in direction parallel to an axis of the shaft, and the first member having an inner spring side and an opposite outer push side adjacent the resilient ring;

a second cylindrical member positioned concentrically about the shaft and being slidably movable with respect to the shaft in direction parallel to the axis of the shaft, and the second member having an inner spring side facing the inner spring side of the first member and an outer press side adjacent a second end of the shaft;

spring means acting on the inner spring sides of the first and second members for urging them apart in the axial direction along the shaft;

a cylindrical compression sleeve positioned concentrically about the shaft and first and second members and being slidably movable with respect to the shaft in direction parallel to the axis of the shaft, and the compression sleeve having an annular ring press surface adjacent the resilient ring, a first inner annular portion proximate the second end of the shaft engaging the outer push side of the second member and a second inner annular portion proximate the ring press side of the compression sleeve engaging the outer press side of the first member to limit the maximum separation of the members on the shaft;

actuation means for selectively moving the second member toward the first member to compress the spring means which further urges the first member toward the first end of the shaft causing the outer push side of the first member to engage the first inner annular portion of the compression sleeve and push the ring press side of the compression sleeve toward the stop shoulder to compress the resilient ring and to deform the ring radially outwardly from the shaft to engage the inner cylindrical surface of the paper roll core to secure the paper roll core concentrically with respect to the shaft for rotation with the shaft; and friction reducing means between the resilient ring and the cylindrical compression sleeve and between the resilient ring and the annular shoulder for uniformly permitting the resilient ring to move radially outwardly fom the shaft and concentrically engage the inner cylindrical surface of the paper roll core.

10. A holding device for securing a photographic paper roll core having an inner cylindrical surface concentrically about a rotatable shaft, the holding device comprising:

an annular shoulder portion fixed concentrically about the shaft;

a cylindrical compression sleeve positioned concentrically about the shaft and movable in an axial direction along the shaft;

a resilient clamping ring positioned concentrically about the shaft between the shoulder and the cylindrical compression sleeve;

means for selectively urging the cylindrical compression sleeve toward the shoulder so that the resilient clamping ring is deformed from a first radially retracted position between the cylindrical compression sleeve and the shoulder into a second radially extended position in which the resilient clamping ring engages the inner cylindrical surface of the paper roll core to secure the paper roll core for rotation with the shaft;

spring bias means for transmitting the urging force from the cam actuated means to the cylindrical sleeve; and a first friction reduction ring between the resilient ring and the cylindrical compression sleeve and a second friction reduction ring between the resilient ring and the annular shoulder, each ring having a plurality of cuts extending radially outwardly from its inner annular edge and a plurality of cuts extending radially inwardly from its outer annular edge so that the rings expand uniformly radially as the resilient ring moves radially outwardly from the shaft to concentrically engage the inner cylindrical surface of the paper core holder.

* * * * *